United States Patent [19]

Fish

[11] 4,244,254

[45] Jan. 13, 1981

[54] CARTON FOR CUTTING AND DISPENSING SHEET MATERIAL

[75] Inventor: Darrell D. Fish, Timonium, Md.

[73] Assignee: Reynolds Metals Company, Richmond, Va.

[21] Appl. No.: 67,563

[22] Filed: Aug. 17, 1979

Related U.S. Application Data

[62] Division of Ser. No. 933,855, Aug. 15, 1978, Pat. No. 4,196,647.

[51] Int. Cl.[3] ..... B26D 1/34

[52] U.S. Cl. ..... 83/589; 83/649; 206/395; 206/407; 225/45; 242/55.53

[58] Field of Search ..... 83/589, 649; 225/45, 225/47; 206/395, 396, 407, 413–416; 242/55.53

[56] References Cited

U.S. PATENT DOCUMENTS

| | | | |
|---|---|---|---|
| 2,031,033 | 2/1936 | Denebeim | 225/47 |
| 3,228,579 | 1/1966 | Dong et al. | 225/47 X |
| 3,419,201 | 12/1968 | Brandon | 83/649 X |
| 4,034,929 | 7/1977 | Ebner, Jr. | 242/55.53 X |
| 4,119,251 | 10/1978 | Golner et al. | 225/47 X |

*Primary Examiner*—Frank T. Yost

*Attorney, Agent, or Firm*—Glenn, Lyne, Girard & McDonald

[57] ABSTRACT

A carton for cutting and dispensing sheet material in flattened form with a cutter mechanism for effecting same. The cutter is part of an upper bar suitably attached to the top wall member of the carton with the top normally maintained open by a spring carried by one or both of separate plastic end cap members. The upper bar also carries a pair of parallel plate-like members which extend laterally for substantially the full length of the carton and engages and wipes past a pair of similar parallel plate-like members on a lower bar attached to the front panel. This wiping action places the sheet material, which is manually positioned to overlie the lower bar, in tension with the cutter severing the tensioned sheet material.

3 Claims, 9 Drawing Figures

CARTON FOR CUTTING AND DISPENSING SHEET MATERIAL

This application is a division, of Ser. No. 933,855 filed Aug. 15, 1978, now U.S. Pat. No. 4,196,647.

BACKGROUND OF THE INVENTION

This invention relates to a carton for cutting and dispensing sheet material with a specially designed cutter and, more particularly, to such a carton and cutter which cuts sheet material from a roll so that the sheet material lies flat after being cut.

Heretofore, it has been known to cut sheet material from roll stock by pulling one side of the film up or down to effect tearing across the cutter blade progressively from one end to another. Difficulties have been experienced, expecially when plastic films are being cut, in that the film does not lay flat against a receiving surface because of air which is trapped beneath the film and because of static friction.

Another problem which has been experienced in the cutting of film is that it has been necessary to employ flush pressure points or foam pads in order to hold the film in a desired position for cutting. These measures have tended to add to the cost of the composite article and in some instances pose sanitary problems, especially when food products are to be encapsulated by the sheet material.

Still another problem, especially where the sheet material is foil, such as aluminum foil, is that some of the cutter constructions tend to sever very small portions of the foil which are referred to in the art as "fines" and which pose a problem especially where the fines have a deleterious effect with respect to the articles being wrapped by the sheet material.

Additional problems encountered in prior art devices for severing sheet material include the tendency of the sheet material slipping back into the carton after a portion thereof has been severed. Other desired features of such a box cutter which sometimes have been lacking in prior art devices are that they should be economical to produce and easily assembled.

SUMMARY OF THE INVENTION

In accordance with the present invention, a box cutter is produced which utilizes a blade mechanism which severs the film from one end to the other substantially simultaneously so as to permit the severed portion of the sheet material to drop vertically and to lay flat against the collecting surface.

Another feature of the present invention is that the sheet material is put in tension on each side of the cutter blade so that the sheet material may be cut cleanly without the use of flush pressure points or the use of foam pads. The blade construction is provided with a radius at its root so as to avoid fines which are customarily or frequently produced when cutting metal foil such as aluminum foil.

The carton is provided with a shelf like arrangement behind the cutter blade which provides a ledge on which the leading edge of the sheet material may rest subsequent to its being severed by the blade mechanism. Finally, the carton construction provides for front, bottom, rear and top wall members to be cut from a strip of paperboard which are serially connected along crease lines or fold lines and a pair of opposed side wall members are made from plastic material. The side wall members have a U-shaped channel groove to receive the front, bottom, and rear wall members so that the carton can be made very economically. The assembly thereof is also easily achieved both with respect to the assembly of the paperboard blank within the plastic end cap members and the cutter mechanism itself which is applied to the top and front panels of the carton.

A unique cutter mechanism is provided with an upper bar mechanism having two substantially parallel planar surfaces disposed on opposite sides of a cutter blade. The upper bar mechanism is attached to a top wall of the carton and a lower bar mechanism having two substantially parallel planar surfaces and an interconnecting web to define a channel is attached to the front panel of the carton. The planar surfaces of the upper bar mechanism are so positioned and arranged that when the top wall of the carton is moved to a substantially horizontal position the inside surfaces of the planar surfaces on the upper bar mechanism engaged the outer surfaces of the channel and exert a wiping action on sheet material overlaying the lower bar mechanism placing the sheet material in tension at which time the cutter blade severs the sheet material across its entire length.

The inherent advantages and improvements of the present invention will become more readily apparent upon referring to the following detailed description of the invention and by reference to the accompanying drawings.

DETAILED DESCRIPTION OF THE PREFERRED EMBODIMENT

Figure 1:
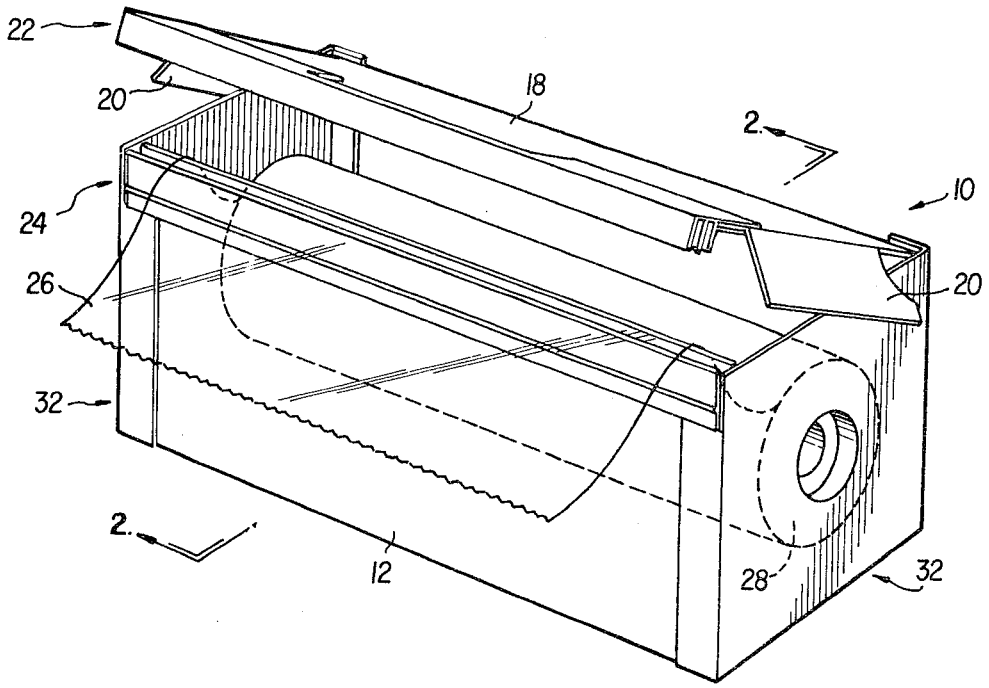
FIG. 1 is a perspective view of the carton cutting and dispensing mechanism of the present invention.
Figure 2:
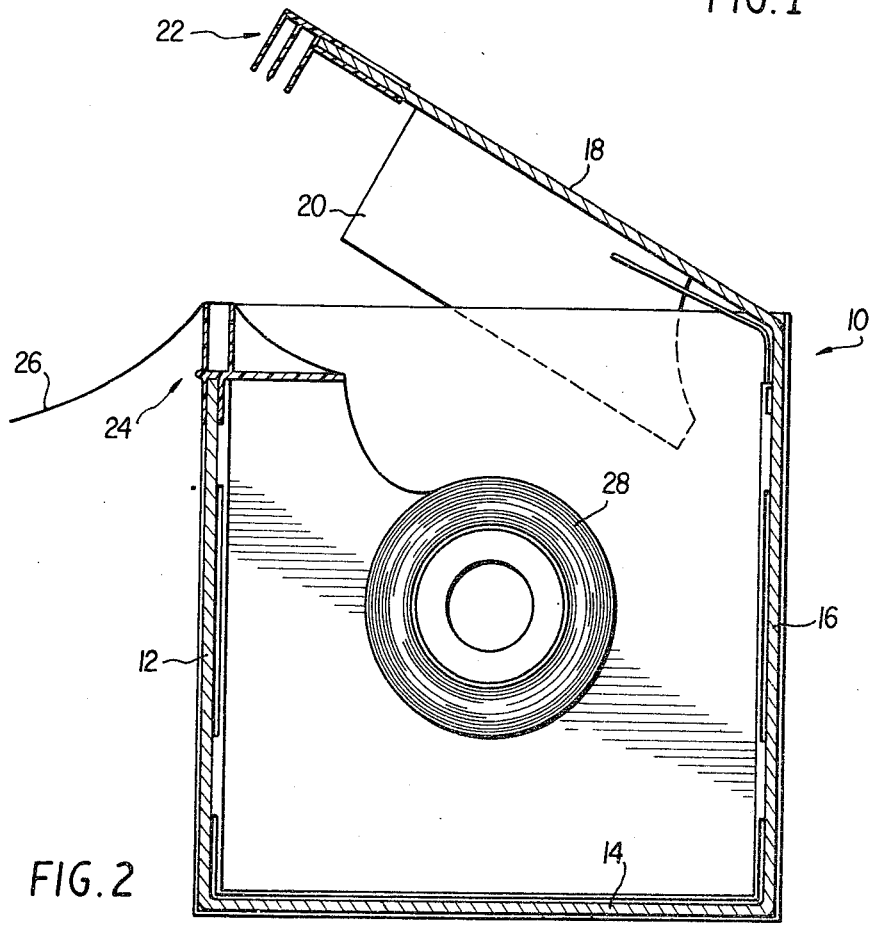
FIG. 2 is an end elevational view taken in vertical cross section along line 2—2 of FIG. 1.

Referring now to FIGS. 1 and 2 of the drawings, there is illustrated a box construction illustrated generally at 10 comprising a parallelpiped having a front panel 12, a bottom panel 14, a rear panel 16, and a top cover panel 18, with each of the panels separated from its adjacent panel by a crease or fold line. Top cover panel 18 may also carry end flap panels 20 at the marginal edges thereof.

For purposes of effecting cutting of sheet material, the top panel 18 is provided with a top bar indicated generally at 22 in FIGS. 1 and 2 and the front panel 12 has secured to it a bottom bar that is indicated generally at 24.

In each of FIGS. 1 and 2 there is illustrated a sheet material to be dispensed which may consist of metal foil, such as aluminum foil, or a plastic sheet material which is dispensed from a roll of sheet material 28, FIG. 2. The roll of sheet material 28 is supported on a hub 30, illustrated in FIG. 8, which is integrally molded or otherwise supported by an end cap member indicated generally at 32 which is made from a plastic material.

Figure 3:
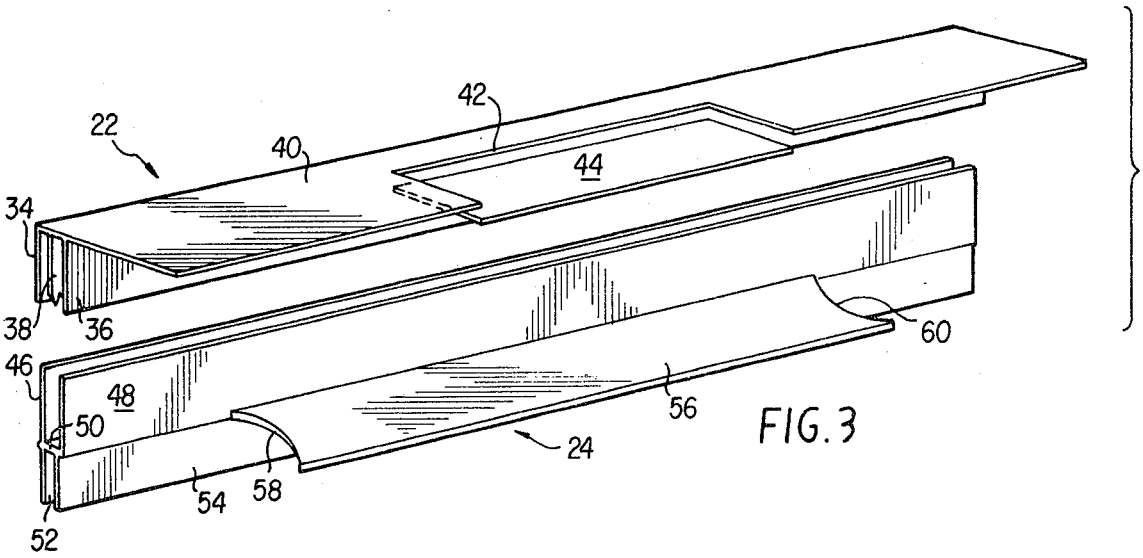
FIG. 3 is a perspective view of the upper and lower bar members disassociated from the carton.
Figure 4:
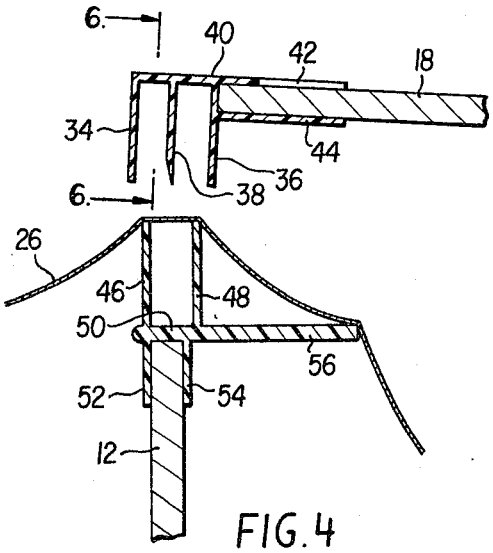
FIG. 4 is a fragmentary end elevational view taken in vertical cross section showing the upper and lower bar members of FIG. 3 attached to the carton and in position prior to cutting a film.
Figure 5:
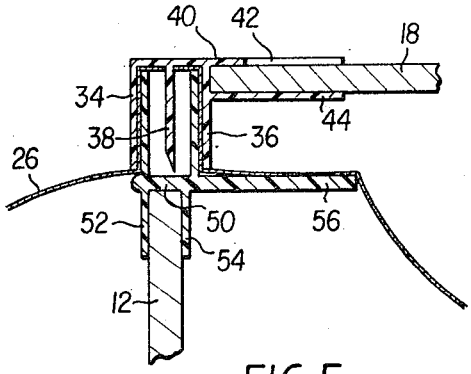
FIG. 5 is a fragmentary end elevational view taken in vertical cross section similar to FIG. 4 but showing the position of the upper and lower bar members after severing the film.

Referring now to FIGS. 3–5, the details of the top and bottom bars 22, 24 which comprise the cutter mechanism will be described. Thus top bar 22 is shown to have a front plate-like member 34 and a rear plate-like member 36 disposed on opposite sides of a cutter blade 38. Each of the front and rear plate-like members 34, 36 and the cutter blade 38 depend downwardly from a top planar surface 40 which provides a web therebetween. This top planar surface 40 extends rearwardly of the cutter mechanism and has a rectangular cutout 42 beneath which extends a bottom planar surface 44 which cooperates with the top planar surface 40 to provide a flanged holder for top panel 18 as is more fully illustrated in FIGS. 4 and 5. In a preferred embodiment of this invention, the top bar 22 is formed from an injection molding although other means of making this top bar may be employed.

The lower bar 24 includes what may be referred to generally as an H-shaped extrusion in which a front upwardly extending flange 46 and a rear upwardly extending flange 48 are joined at their bases by an interconnecting web member 50. Web member 50 also carries a front downwardly extending flange 52 and a rear downwardly extending flange 54 which cooperate to receive front panel 12 therein in the manner illustrated in FIGS. 4 and 5.

Extending rearwardly from the H-shaped extrusion of the bottom bar 24 is a horizontal platform 56 in line with web member 50 having edges 58 and 60 spaced inwardly from the marginal edges of the H-shaped extrusion so as to provide finger holes within the carton by means of which the user may grasp the sheet material. In addition, the horizontal platform 56 serves to support the edge of the sheet material 26 after the sheet material has been severed by the cutter blade 38.

Figure 6:
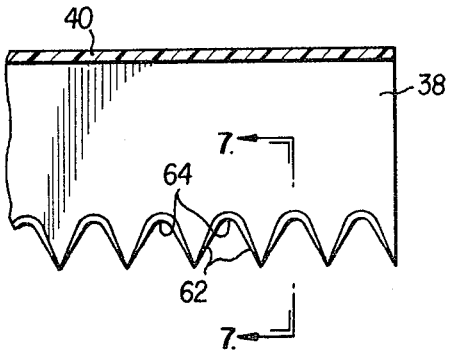
FIG. 6 is a fragmentary front elevational view, drawn to an enlarged scale, and taken in vertical cross section along line 6—6 of FIG. 4.
Figure 7:
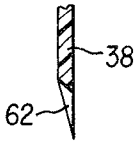
FIG. 7 is a fragmentary end elevational view taken in vertical cross section along line 7—7 of FIG. 6

Referring now to FIGS. 6 and 7 there are illustrated the details of the cutter blade 38. In particular, individual V-shaped cutting teeth 62 are shown to be provided with a radius at the root thereof so as to avoid fines in the sheet material being cut, especially when the sheet material is metal foil such as aluminum foil.

Figure 8:
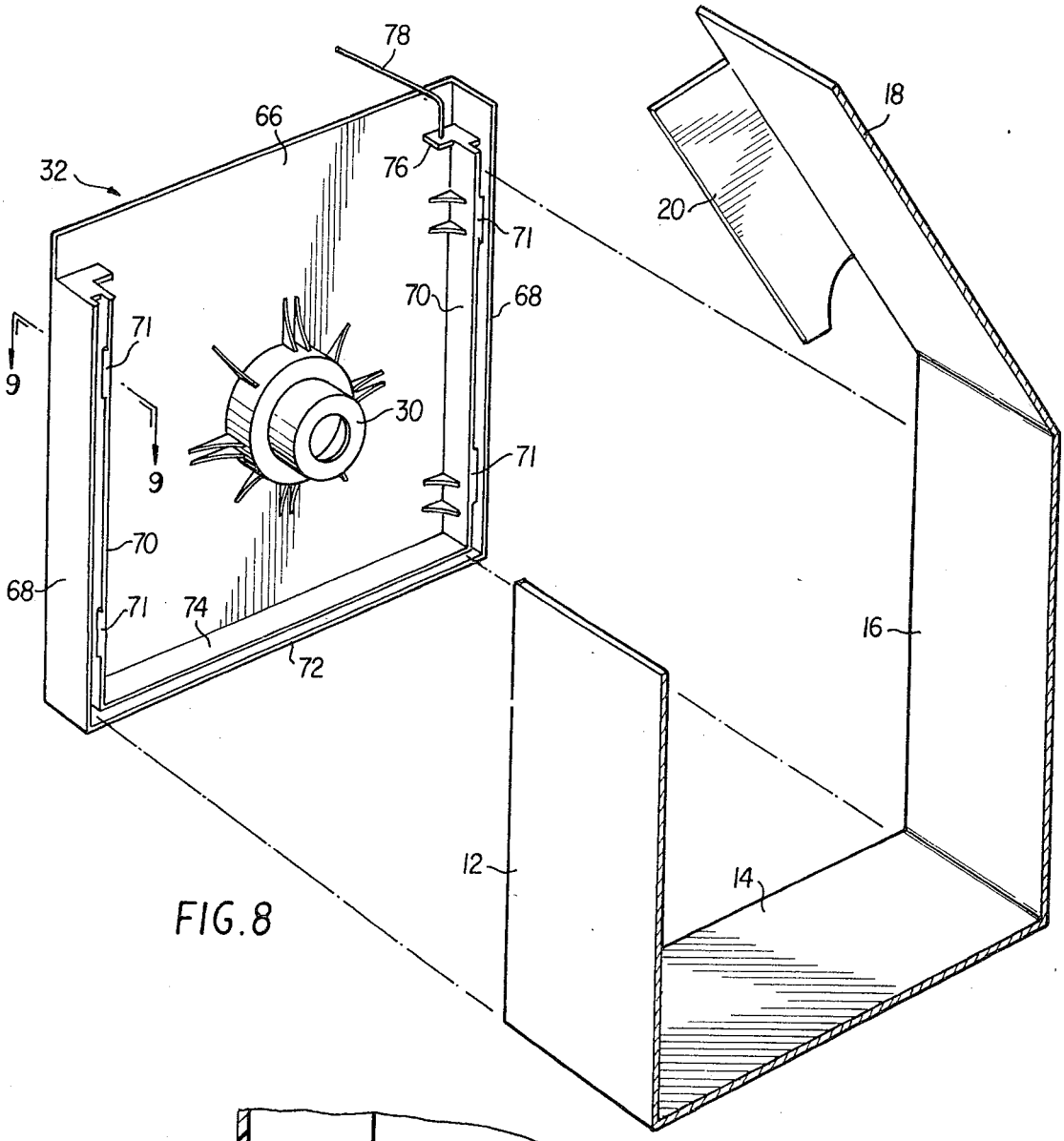
FIG. 8 is a fragmentary exploded perspective view illustrating the assembly of the carton body with one of the end cap members.
Figure 9:
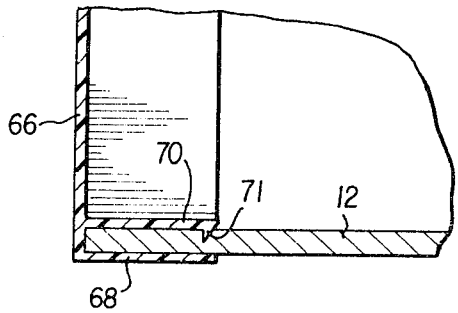
FIG. 9 is a fragmentary front elevational view taken in vertical cross section along line 9—9 of FIG. 8.

Referring now to FIGS. 8 and 9 there is illustrated one of the plastic side wall members 66 which in addition to hub 30 is shown to be provided with a substantially U-shaped channel construction so as to receive the front, bottom and rear walls of the paperboard construction of the box. Thus, by providing vertically extending parallel walls 68, 70 a channel is defined on each edge of plastic side wall 66 to receive the front wall 12 and the rear wall 16, respectively. Each of the vertically extending walls 70 are shown to be provided with two locking tabs 71 which secure the paperboard panels of the box construction such as the front panel 12 illustrated in FIG. 9. Similarly, horizontally extending parallel walls 72, 74 define a channel at the bottom of the plastic side wall 66 which receive the bottom panel 14 of the box construction. It will be appreciated that by using paperboard construction only for the front, bottom, rear and top walls of the carton and using separately formed plastic members 66 as end cap members that substantial savings may be achieved in the use of paperboard which is formed from strip stock in that a substantial amount of waste that is occasioned by the necessity for providing integral end members for the carton blank construction is eliminated.

In order to provide the box construction with an open top construction making it readily available for dispensing of the sheet material, a tab member is provided at 76 on either one or both of the plastic side wall members 66 and a spring member 78 carried thereby so as to maintain the top cover panel 18 open in the positions illustrated in FIGS. 1 and 2 whereby the user may readily insert his fingers over the front panel 12 into the space adjacent the edges 58 and 60 of the horizontal platform 56 so as to grasp the free end of the sheet material 26. Although the illustrated spring means consists simply of a bent metal wire, other spring means may be employed.

In shipping the carton to its destination or origin of use, the spring pressure provided by spring 78 is overcome and the carton is taped closed. When it is desired to use the box construction 10 as a dispenser of sheet material, the shipping tape is removed and the spring 78 permitted to hold the top cover panel 18 in a normally open position as illustrated in FIGS. 1 and 2. The user initially grasps the free end of sheet material and pulls it to a desired dispensing length at which time the top cover panel is pushed from its normally open position of FIGS. 1 and 2 to the position illustrated in FIG. 5 at which time the sheet material is cut substantially instantaneously and cleanly to dispense the sheet material. However, before this can happen and for it to happen properly the upper bar construction 22 is so positioned and arranged that when the top wall of the carton is moved to a substantially horizontal plane from the FIG. 4 to the FIG. 5 position, the inside surfaces of planar surfaces provided by plate-like members 34 and 36 engage the outer surfaces of the front and rear upwardly extending flanges 46, 48 on the lower bar mechanism 24 thereby exerting a wiping action on the sheet material which extends or overlays the lower bar mechanism placing the sheet material in tension and stretching plastic sheet material so that the blade 38 severs the sheet material while it is under tension. The teeth on the cutter blade 38 are substantially V-shaped with their roots being formed with a sufficient radius to prevent the generation of fines from the sheet material cut by the cutter mechanism. The cutter blade 38 itself is made from a plastic material. The lower bar mechanism may be formed from a plastic extrusion.

In addition to the use of horizontal platform 56 to support the end of the sheet material 26, it has been found advantageous to coat the upper edges of flange 48 with a sticky material, such as a rubber cement. This has been found to be especially beneficial when plastic sheet material is being dispensed.

While a presently preferred embodiment of the invention has been illustrated and described, it will be recognized that the invention may be otherwise variously embodied and practiced within the scope of the claims which follow.

What is claimed is:

1. A carton construction for dispensing sheet material which comprises (a) front, bottom, rear and top wall members cut from a strip of paperboard and serially connected along laterally spaced fold lines, (b) a pair of opposed side wall members made from a plastic material;

(1) each of said side wall members having a U-shaped channelled groove to receive the front, bottom, and rear wall members, (2) each of said side wall members further having roll receiving means, (c) and said front and top wall members having cooperating cutter means to sever and dispense sheet material supported on said roll receiving means.

2. A carton construction for dispensing sheet material as defined in claim 1 including spring means carried by at least one of said end cap members to maintain said top wall member normally open.

3. A carton construction for dispensing sheet material as defined in claim 1 wherein said cutter means extend substantially entirely across said front and top wall member to sever said sheet material substantially simultaneously across its entire length thereby dispensing the severed portion of said sheet material in a flat condition.

* * * * *